US007503350B2

(12) United States Patent
Quigley

(10) Patent No.: US 7,503,350 B2
(45) Date of Patent: Mar. 17, 2009

(54) COMPOUND FORMING FABRIC WITH ADDITIONAL BOTTOM YARNS

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 66 days.

(21) Appl. No.: 11/494,323

(22) Filed: Jul. 27, 2006

(65) Prior Publication Data

US 2007/0028996 A1 Feb. 8, 2007

Related U.S. Application Data

(60) Provisional application No. 60/705,076, filed on Aug. 3, 2005.

(51) Int. Cl.
*D21F 7/08* (2006.01)
*D03D 3/04* (2006.01)
*D03D 25/00* (2006.01)

(52) U.S. Cl. ..... 139/383 A; 139/383 R; 139/383 AA; 162/348; 162/358.2

(58) Field of Classification Search ..... 139/383 A; 162/358.2, 348, 901, 903
See application file for complete search history.

(56) References Cited

U.S. PATENT DOCUMENTS 4,771,814 A * 9/1988 Quigley ..... 139/383 AA
5,101,866 A * 4/1992 Quigley ..... 139/383 A
5,343,896 A * 9/1994 Schroder et al. ..... 139/383 A
5,555,917 A * 9/1996 Quigley ..... 139/383 A
5,694,980 A * 12/1997 Quigley ..... 139/383 A
5,713,397 A * 2/1998 Quigley ..... 139/383 A
5,826,627 A * 10/1998 Seabrook et al. ..... 139/383 A
5,988,229 A * 11/1999 Quigley ..... 139/383 A
6,148,869 A * 11/2000 Quigley ..... 139/383 A
6,202,705 B1 * 3/2001 Johnson et al. ..... 139/383 A
6,227,256 B1 * 5/2001 Quigley ..... 139/383 A (Continued)

FOREIGN PATENT DOCUMENTS

WO WO 2006/034576 4/2006

OTHER PUBLICATIONS www.teampuma.co.za/dictfull.htm; Full dictionary of textile terms, Float.*

(Continued)

*Primary Examiner*—Bobby H Muromoto, Jr.
(74) *Attorney, Agent, or Firm*—Taylor & Aust, P.C.

(57) ABSTRACT

A forming fabric is formed by repeat units, being determined by a paper side weave and a wear side weave, the paper side weave having first yarns being interwoven with second yarns extending in cross direction relative to the first yarns. The first yarns passing over one or more consecutive second yarns define over-floats and first yarns passing under one or more consecutive second yarns define under-floats. Each weave repeat unit has at least two like floats having different lengths and forming part of the paper side weave, wherein floats are like floats if all of the floats are either over-floats or under-floats. A "float" as used herein is defined as being either an over-float or an under-float, an over-float being defined by a yarn weaving over one or more consecutive yarns extending in cross direction relative thereto, an under-float being defined by a yarn weaving under one or more consecutive yarns extending in cross direction relative thereto.

18 Claims, 6 Drawing Sheets

U.S. PATENT DOCUMENTS

| | | | | |
|---|---|---|---|---|
| 6,354,335 | B1 * | 3/2002 | Taipale et al. | 139/383 A |
| 6,581,645 | B1 * | 6/2003 | Johnson et al. | 139/383 A |
| 6,926,043 | B2 * | 8/2005 | Quigley et al. | 139/383 A |
| 6,978,809 | B2 * | 12/2005 | Quigley | 139/383 A |
| 7,007,722 | B2 * | 3/2006 | Quigley et al. | 139/383 A |
| 7,048,012 | B2 * | 5/2006 | Martin et al. | 139/383 A |
| 7,059,359 | B2 * | 6/2006 | Quigley et al. | 139/383 A |
| 7,059,361 | B1 * | 6/2006 | Hansson | 139/383 A |
| 7,198,067 | B2 * | 4/2007 | Collegnon | 139/383 A |
| 2003/0024590 | A1 * | 2/2003 | Stone | 139/408 |
| 2004/0118473 | A1 | 6/2004 | Hay et al. | 139/383 |
| 2004/0231745 | A1 * | 11/2004 | Quigley et al. | 139/383 A |
| 2004/0238062 | A1 * | 12/2004 | Quigley et al. | 139/383 A |
| 2005/0067040 | A1 * | 3/2005 | Quigley | 139/383 A |
| 2005/0103397 | A1 * | 5/2005 | Quigley et al. | 139/383 A |
| 2005/0139281 | A1 * | 6/2005 | Martin et al. | 139/383 A |

OTHER PUBLICATIONS www.chezirene.com/articles/precostuming/fabgloss.html; Glossary of fabric terms, Float.*

* cited by examiner

COMPOUND FORMING FABRIC WITH ADDITIONAL BOTTOM YARNS

CROSS-REFERENCE TO RELATED APPLICATIONS

The present application claims priority under 35 U.S.C. §119(e) of U.S. Patent Application No. 60/705,076 filed Aug. 3, 2005, the disclosure of which is expressly incorporated herein in its entirety.

BACKGROUND OF THE INVENTION

1. Field of the Invention

The present invention relates to forming fabrics for use in the forming section of a paper machine to manufacture board and packaging paper.

2. Discussion of Background Information

Various styles of forming fabrics are known in the art. Forming fabrics known in the art offer a monoplane forming surface to the paper furnish laid down. The monoplane forming surface can lead to a sheet being formed in a layered manner having minimal fibre bonding in vertical direction leading to unsatisfactory mechanical properties of the paper sheet, like e.g. tensile strength. Especially board and packaging paper must have mechanical strength.

SUMMARY OF THE INVENTION

It is the object of the present invention to provide a forming fabric supplying a forming surface effecting increased vertical bonding of the fibres in the paper sheet.

According to the invention there is provided a forming fabric having a paper side weave being repeated in paper side repeat units, said paper side weave comprising first yarns weaving with second yarns, said second yarns extending in cross direction relative to said first yarns, said first yarns weaving over one or more consecutive second yarns to define first over-floats and said first yarns weaving under one or more consecutive second yarns to define first under-floats. The fabric according to the invention is characterized in that each paper side weave repeat unit comprise at least two like first floats having different lengths and forming part of the paper side weave, wherein floats are like first floats if all of said first floats are either first over-floats or first under-floats. A "float" as used herein is defined as being either an over-float or an under-float, an over-float being defined by a yarn weaving over one or more consecutive yarns extending in cross direction relative thereto, an under-float being defined by a yarn weaving under one or more consecutive yarns extending in cross direction relative thereto.

By providing at least two like floats per weave repeat unit having different lengths a textured paper side or forming surface is generated forcing part of the fibres of the paper furnish which is laid down onto the forming surface to orientate vertically thereby increasing vertical bonding of the fibres in the paper sheet leading to improved mechanical properties of the formed paper sheet.

According to a preferred embodiment of the present invention at least two of said like floats being different in length are formed by the weaving of one of said first yarns with said second yarns.

According to the invention it is possible that said like first floats being defined by under-floats of said first yarns under one of said second yarns and by under-floats of said first yarns under at least two of said consecutive second yarns. By doing this a textured surface can be created having sufficient fibre support.

Preferably the like first floats being defined by over-floats of said first yarns over one of said second yarns and by over-floats of said first yarns over at least two of said consecutive second yarns.

According to a preferred embodiment it is foreseen that the paper side weave repeat unit further comprise at least two like second over- or under-floats having different lengths, wherein second over-floats being defined by weaving of said second yarns over one or more consecutive first yarns, wherein second under-floats being defined by weaving of said second yarns under one or more consecutive first yarns and wherein floats are like second floats if all of said second floats are either second over-floats or second under-floats. By providing like first floats having different length as well as like second floats having different length the above mentioned texturing effect of the paper contacting side can be increased leading to the improved mechanical properties of the formed paper sheet. By way of example as can be seen best in FIG. 4 where the paper side weave comprise first like floats, being under-floats (warp floats), having different lengths of 1 and 3 and second like floats, being under-floats (weft floats), having different lengths of 1 and 3.

According to a further preferred embodiment at least two of said second like floats having different lengths being formed by the weaving of a second yarn weaving with first yarns.

Said like second floats further can be defined by under-floats of said second yarns under one of said first yarns and by under-floats of said second yarns under at least two of said consecutive first yarns.

In addition or alternatively said like second floats can be defined by over-floats of said first yarns over one of said second yarns and by first over-floats of said first yarns over at least two of said consecutive second yarns.

According to the present invention it is optionally possible that said first yarns are weft yarns and that said second yarns are warp yarns or that said first yarns are warp yarns and that said second yarns are weft yarns.

The forming fabric according to the present invention in addition can be a compound forming fabric having binder yarns binding together the paper side weave and the wear side weave. According to a further preferred embodiment of the present invention said forming fabric comprising at least one pair of binder yarns, the binder yarns of which alternately weave with paper side yarns and with wear side yarns such that they together form a full weave path as a first or a second yarn of the paper side weave. This means that the binder yarns of each pair together weave the weave path on the paper side like a first yarn or a second yarn.

Therefore also binder yarns can form a textured surface by together providing for the paper side weave like floats being different in length.

According to a further embodiment the paper side weave only comprise pairs of binder yarns, preferably being warp yarns, interwoven with said paper side yarns, preferably being weft yarns, wherein each of said pair forms a weave path on the paper side like a first or a second yarn.

According to another preferred embodiment of the present invention the paper side yarns and the wear side yarns extending in cross direction relative to said binder yarns have a ratio of 1:1 or 2:1 or 3:2. By varying the ratio of the paper side weft yarns to the wear side weft yarns e.g. the wear resistance or the drainage capability of the fabric according to the invention can be influenced according to the requirements of the specific application.

According to a concrete example the forming fabric is formed by weave repeat units determined by the paper side weave and the wear side weave, wherein the repeat unit of the fabric comprises 16 warp yarns or more.

Further the repeat unit of the forming fabric according to the invention comprise 24 weft yarns or more.

According to a further preferred embodiment of the invention it is foreseen that the paper side weave comprise unlike floats having a difference of level being greater than 0.02 mm, preferable in the range of 0.02 mm to 0.05 mm. Two adjacent floats are unlike floats if one of said two adjacent floats is an over-float and the other of said two adjacent floats is an under-float or vice versa.

By providing a textured paper side or forming surface having a difference of level being greater than 0.02 mm, preferable in the range of 0.02 to 0.05 mm the effect of increased vertical bonding of the fibres in the paper sheet is enhanced leading to improved mechanical properties of the paper sheet. Especially by providing a difference of level being in the range of 0.02 mm to 0.05 mm a optimum balance between increased fibre bonding in vertical direction and sufficient compactness of the paper sheet being produced is achieved.

According to a second aspect of the present invention the forming surface of the textured fabric comprises a paper side weave formed by interweaving of first and second yarns, said second yarns extending in cross direction relative to said first yarns, the paper side weave provides pockets, a pocket being defined by weaving of at least one first yarn under at least two consecutive second yarns, the pockets having a depth being defined by the difference of level of said first yarn when weaving over said second yarns and when weaving under said second yarns, the depth of said pocket being equal or greater than 0.02 mm, preferably in the range of 0.02 to 0.05 mm.

According to the present invention it is optionally possible that said first yarns are weft yarns and that said second yarns are warp yarns or that said first yarns are warp yarns and that said second yarns are weft yarns.

According to a third aspect of the present invention a method of manufacturing a board and packaging paper web is provided, wherein the paper web is formed on a forming surface of a forming fabric, the forming surface being textured.

By using a forming fabric having a textured forming surface board an packaging paper can be produced having increased 3-dimensional strength leading to a product having better tensile strength compared to board and packaging paper formed on the forming surface of a forming fabric having a flat forming surface.

The board and packaging paper web produced with the fabric according to the invention has an increased ring crush value or alternately ring crush target values can be met by less reefing the fibre less, whereby less fibre refining saves power.

According to further embodiments of the method of manufacturing a board and packaging paper web the forming fabrics used can comprise the features as disclosed in at least one of the claims of the first and/or second aspect of the invention.

BRIEF DESCRIPTION OF THE DRAWINGS

The present invention if further described in the detailed description which follows, in reference to the noted drawing by way of non-limiting example of exemplary embodiment of the present invention, and wherein.

DETAILED DESCRIPTION OF THE PRESENT INVENTION

The particulars shown herein are by way of example and for purposed of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1A:
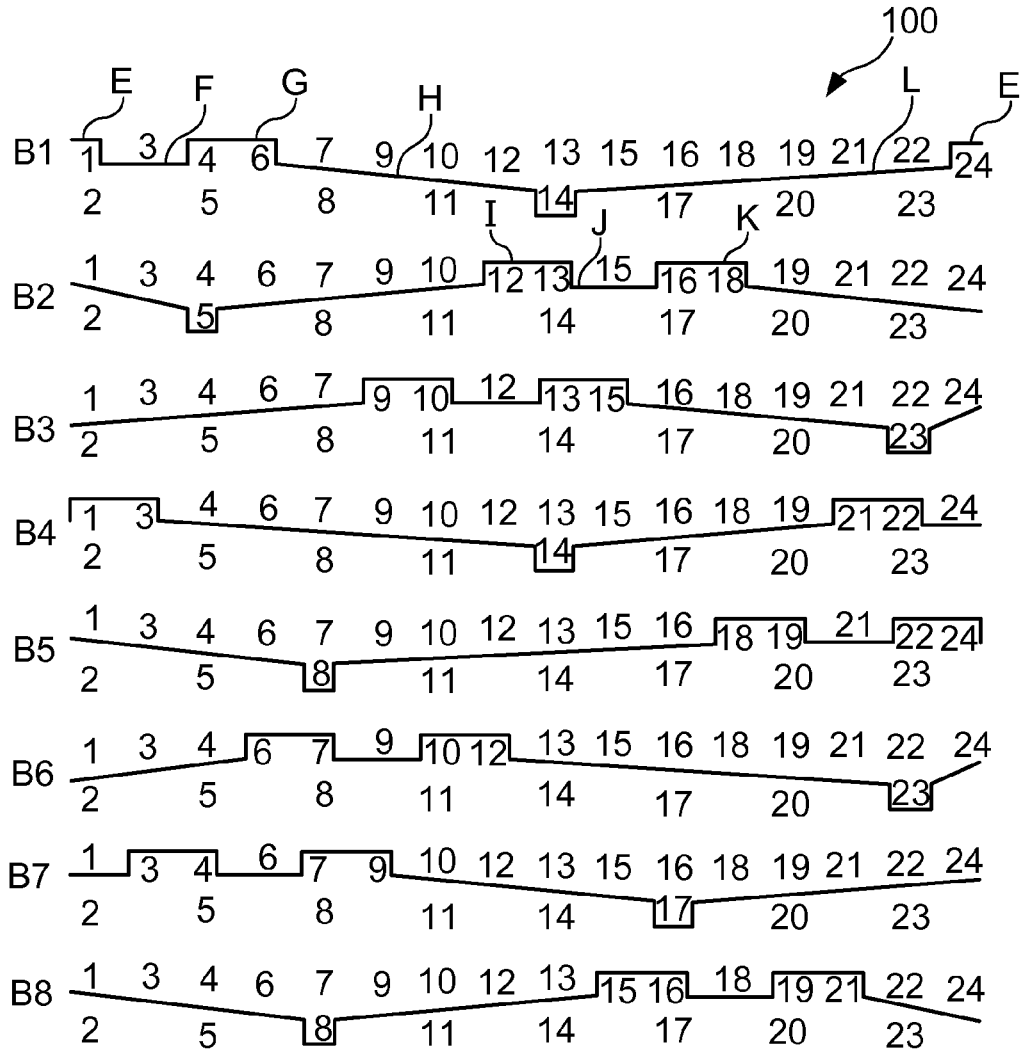
FIGS. 1A-1B show a series of weft cross sectional diagrams showing consecutive warp paths of all of the warp yarns in a compound forming fabric in accordance with the present invention.
Figure 1B:
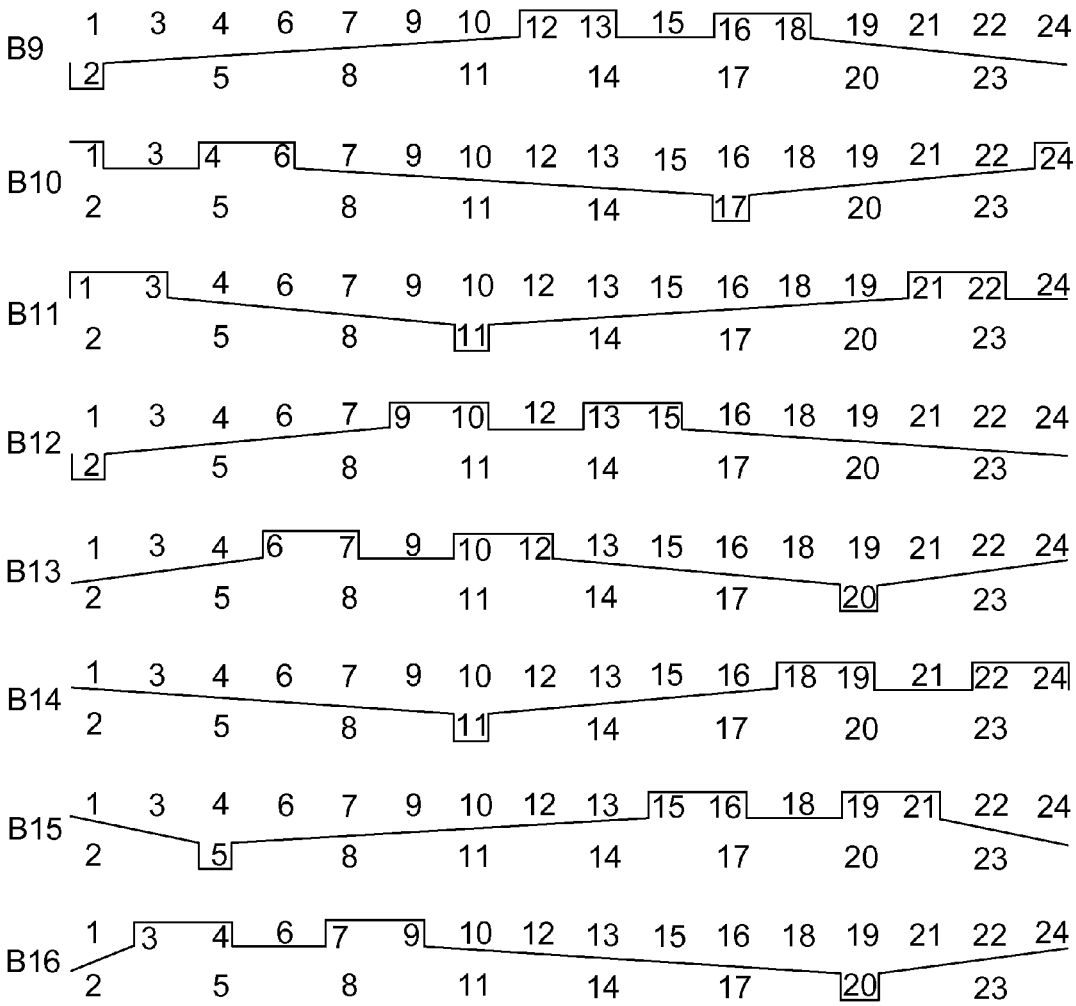

FIGS. 1A-1B show the weave paths in warp direction of a forming fabric according to a first embodiment of the invention.

The forming fabric 100 is formed by repeat units, being determined by a paper side weave and a wear side weave. Each repeat unit comprise 24 weft yarns and 16 warp yarns.

Weft yarns are indicated with reference numbers 1 to 24 and warp yarns are indicated with reference numbers B1 to B 16.

Weft yarns 1, 3, 4, 6, 7, 9, 10, 12, 13, 15, 16, 18, 19, 21, 22 and 24 are paper side weft yarns and weft yarns 2, 5, 8, 11, 14, 17, 20 and 23 are wear side weft yarns. The paper side yarns and the wear side yarns having a ratio of 2:1.

Binder yarns B1 to B16 are grouped in pairs B1 B2, B3 B4, B5 B6, . . . of exchanging binder yarns weaving with paper side weft yarns 1, 3, 4, 6, 7, 9, 10, 12, 13, 15, 16, 18, 19, 21, 22 and 24 and the wear side weft yarns 2, 5, 8, 11, 14, 17, 20 and 23. Each pair of warp yarns together forms a full weave path of the paper side weave and of the wear side weave.

Each pair together forms a full weave path of the paper side like a first yarn according to the invention, that means each pair of binder yarns together forms on the paper side at least two like floats having different length.

By way of example binder yarns B1 and B2 together form on the paper side the weave path of a first yarn which is as follows:

First yarn floats over the two consecutive paper side weft yarns 24 and 1 defining a first over-float E. After that first yarn floats under paper side weft yarn 3 defining a first under-float F before floating over adjacent paper side weft yarns 4 and 6 defining a further first over-float G. Further first yarn floats under consecutive paper side weft yarns 7, 9 and 10 defining a further first under-float H before floating over paper side wefts 12, 13 defining a first over-float I. Further first yarn floats under paper side weft 15, defining first under-float J, before floating over paper side weft yarns 16 and 18 defining first over-float K. At the end of the weave path said first yarn floats under paper side weft yarns 19, 21 and 22 defining first under-float L.

As can be seen floats E, G, I and K are like first floats—first over-floats- and floats F, H, J and L are like first floats—first under-floats.

Under-floats L and H can be defined as pockets.

Like first over-floats E, G, I and K all have the same length. According to the invention first under-floats F and J have different lengths compared with first under-floats H and L. Therefore it can be stated that each weave repeat unit comprise at least two like first floats having different lengths and forming part of the paper side weave.

The above mentioned is applicable in a similar manner as regards to binder yarns B3 to B16.

Figure 2:
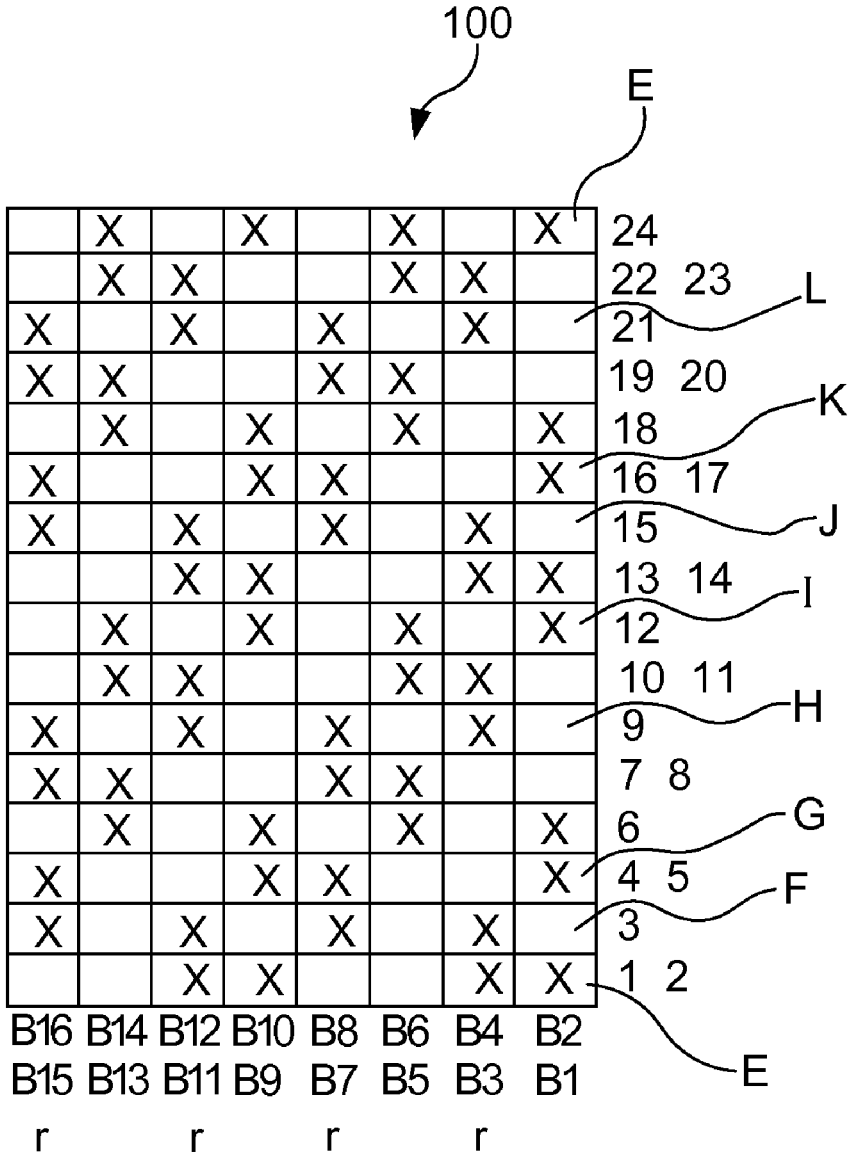
FIG. 2 shows a weave pattern of the paper side weave of the fabric shown in FIGS. 1A-1B.

FIG. 2 is a top view onto the paper side weave of the fabric discussed in FIGS. 1A-1B. The left column indicating the weave path of a first yarn being together formed by the binder yarns B1 and B2. Each field in the matrix indicates the position of one of the paper side weft yarns 1, 3, 4, 6, 7, 9, 10, 12, 13, 15, 16, 18, 19, 21, 22 and 24 relative to the pairs of binders (B1, B2), (B3, B4), . . . Empty fields indicating the float of first yarn under said paper side weft yarns defining the above discussed first under-floats F, H, J and L. Crossed fields indicating the float of first yarn over said paper side weft yarns defining the above discussed first over-floats E, G, I, K. According to the invention at least two of the first under-floats have different float lengths. Crossed fields indicating the float of first yarn over said paper side weft yarns defining first over-floats E, G, I and K having the same float lengths.

Figure 3:
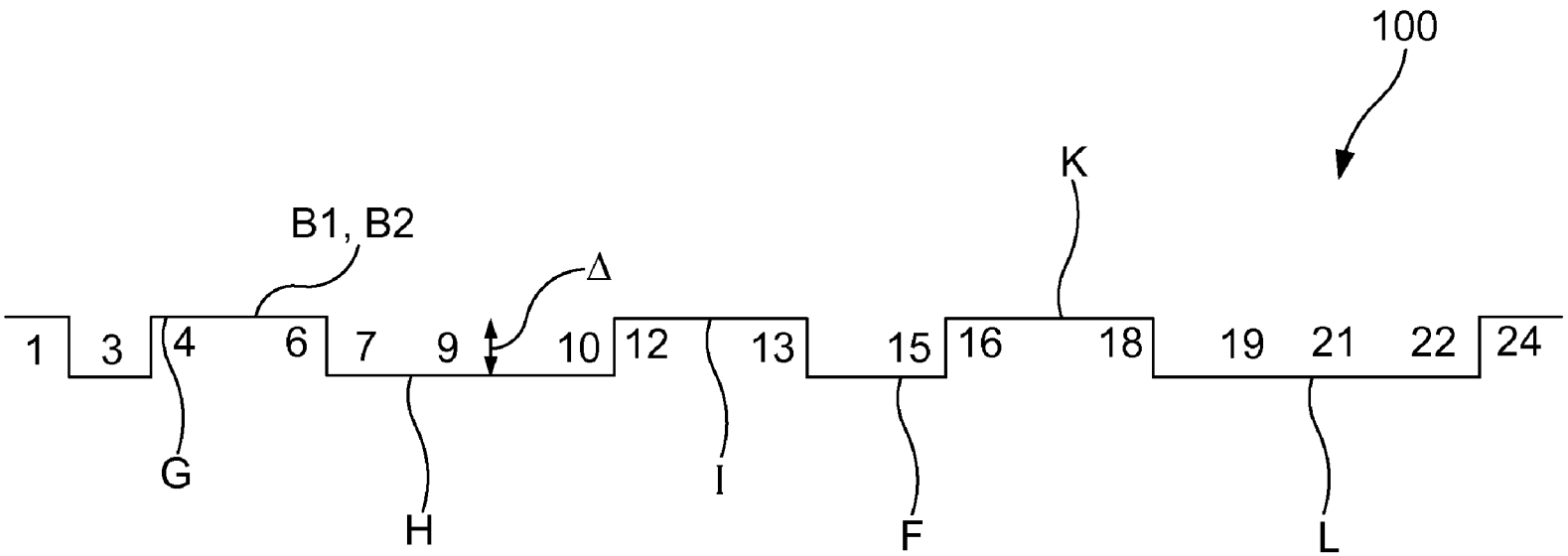
FIG. 3 shows the common weave path of a binder pair weaving with the paper side weft yarns of the fabric shown in FIGS. 1A-1B.

FIG. 3 shows the weave path of first yarn provided by binder yarns B1, B2 interweaving with paper side weft yarns 1, 3, 4, 6, 7, 9, 10, 12, 13, 15, 16, 18, 19, 21, 22 and 24, defining pockets H or L. The depth of the pocket H e.g. is measured by the difference of level Δ of first yarn forming over-float G compared to first yarn forming first under-float H (the difference of level can e.g. be measured from middle of diameter of first yarn when forming the over-float to middle of diameter of first yarn when forming the under-float).

Figure 4:
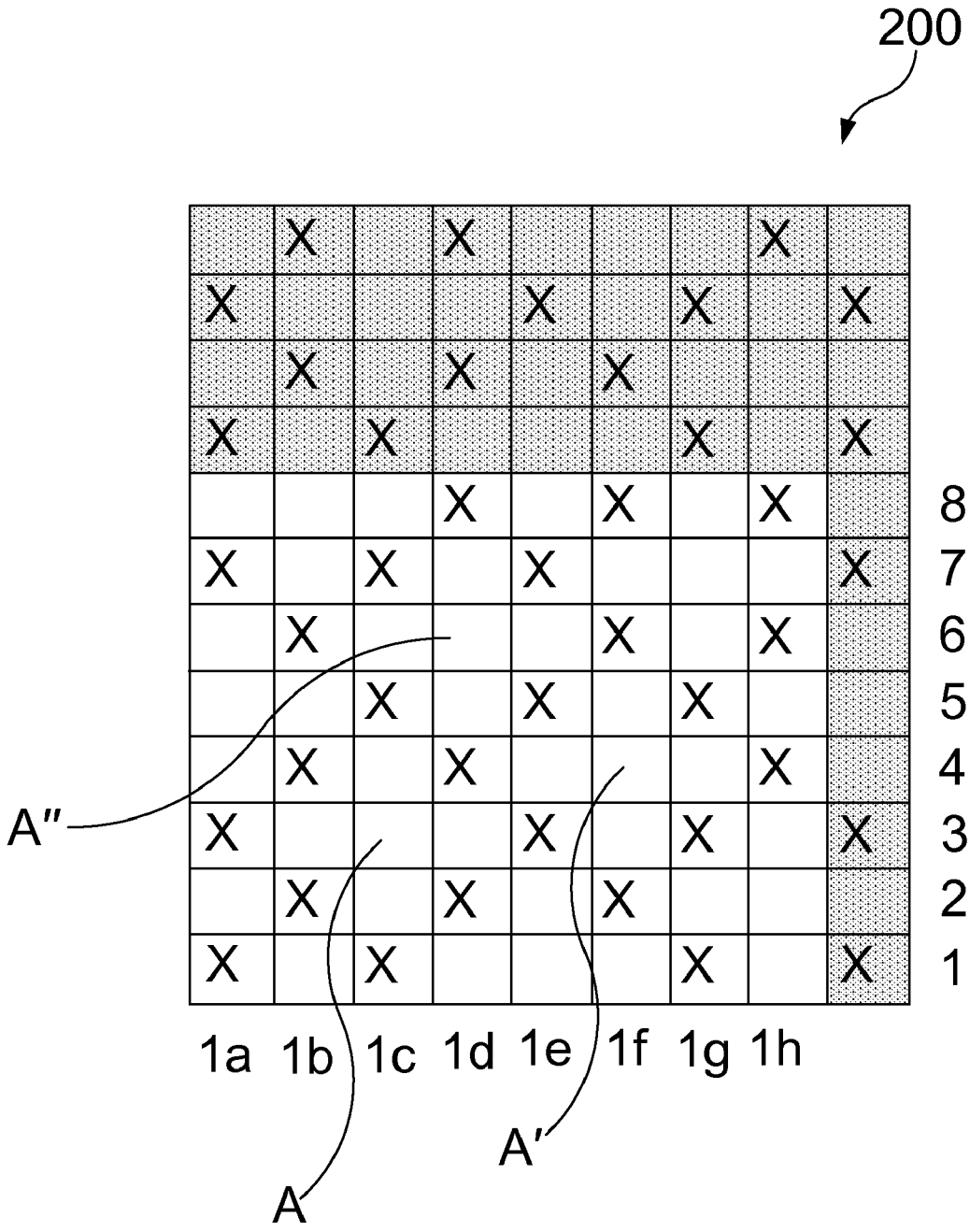
FIG. 4 shows a weave pattern of the paper side weave of a second fabric according to the invention.

FIG. 4 is a top view onto the paper side weave of a further embodiment of a forming fabric 200. FIG. 4 only considers the paper side weave of forming fabric 200. The paper side weave repeat unit is formed by interweaving of paper side weft yarns 1 to 8, being second yarns, and paper side warp yarns 1*a* to 1*h*, being first yarns. Each of first yarns also could be defined by a pair of binder yarns. As discussed empty fields in the matrix indicate the float of first yarns under second yarns defining first under-floats. Crossed fields indicating the float of first yarns over said second yarns defining the above discussed first over-floats.

As can be seen the paper side weave repeat unit comprise at least two like first floats, being first under-floats, having different lengths as well as at least two like second floats having different lengths.

The at least two first like floats having different lengths being formed by the weaving of a first yarn weaving with second yarns. By way of example first yarn 1*a* forms first under-floats having length of one second yarn by weaving under second yarns 2 and 8. Further first yarn 1*a* forms first under-floats having length of three second yarns by weaving under consecutive second yarns 4,5,6.

Further at least two second like floats having different lengths being formed by the weaving of a second yarn weaving with first yarns. By way of example second yarn 1 forms second under-floats having length of one first yarn by weaving under first yarns 1*b*, 1*h*. Further second yarn 1 forms second under-floats having length of three first yarns by weaving under consecutive first yarns 1*d*, 1*e*, 1*f*.

Said like first floats being defined by under-floats of said first yarns under one of said second yarns and by under-floats of said first yarns under at three of said consecutive second yarns as well as said like second floats being defined by under-floats of said second yarns under one of said first yarns and by under-floats of said second yarns under at least two of said consecutive first yarns.

Pockets A, A', A" . . . are provided in the paper side weave being defined by recessed areas comprising at least one first yarn weaving under at least two consecutive second yarns. By way of example pocket A is formed by float of warp 1*b* under weft yarn 3, by warp 1*c* floating under consecutive wefts 2, 3 and 4 and by float of warp 1*d* under weft 3.

Figure 5:
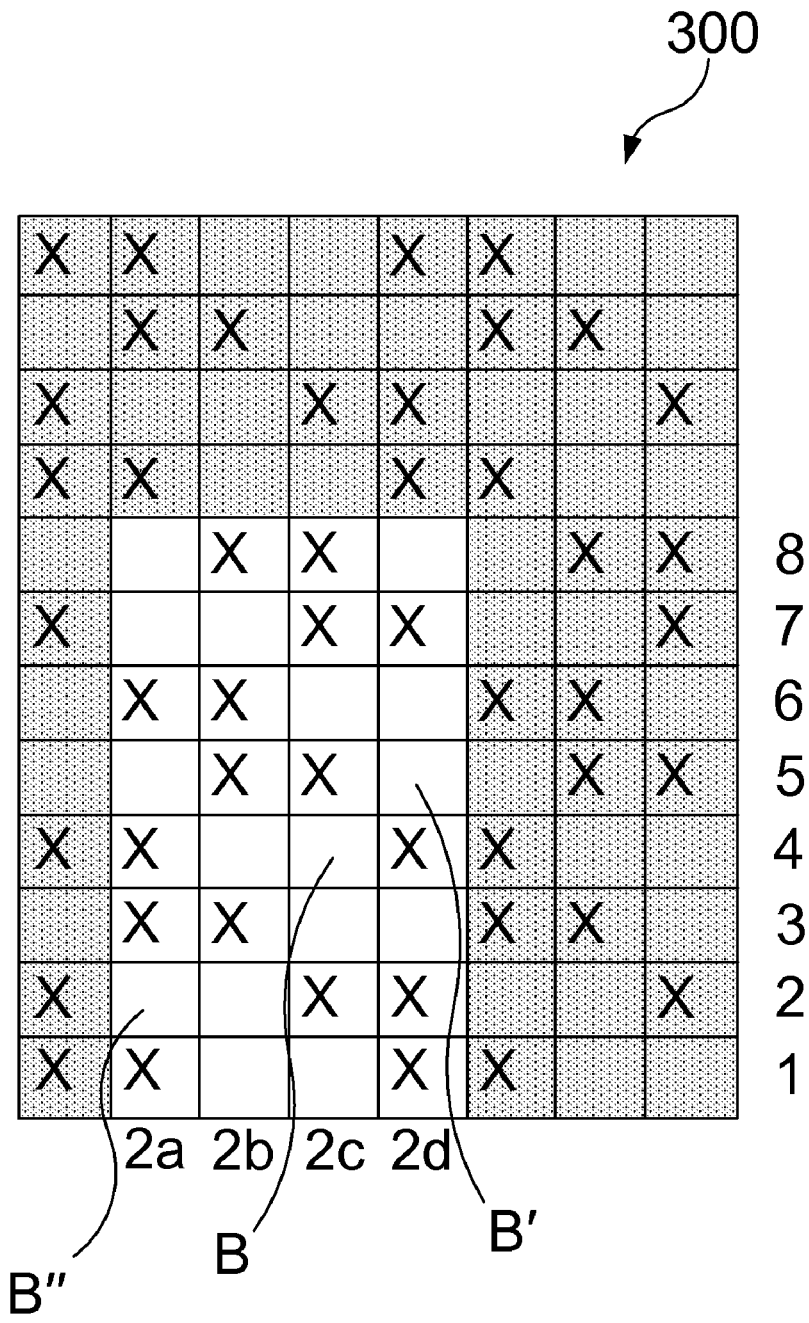
FIG. 5 shows a weave pattern of the paper side weave of a third fabric according to the invention.

FIG. 5 is a top view onto the paper side weave of a further embodiment of a forming fabric 300. FIG. 5 only considers the paper side weave of forming fabric 300. The paper side weave repeat unit is formed by interweaving of paper side weft yarns 1 to 8 and paper side warp yarns 2*a* to 2*d*, being first yarns. Each of first yarns also could be defined by a pair of binder yarns. As discussed empty fields in the matrix indicate the float of first yarns under paper side weft yarns defining under-floats. Crossed fields indicating the float of first yarns over said paper side weft yarns defining the above discussed first over-floats.

Pockets B, B', B" . . . are provided in the paper side weave being defined by recessed areas comprising at least one first yarn weaving under at least two consecutive second yarns. By way of example pocket B is formed by float of warp 2*c* under consecutive weft yarns 3,4 and by float of warp 2*d* under weft 3.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A forming fabric having a paper side weave being repeated in paper side repeat units, said paper side weave comprising:

first yarns weaving with second yarns, said second yarns extending in cross direction relative to said first yarns, said first yarns weave over one or more consecutive second yarns to define first over-floats and under one or more consecutive second yarns to define first under-floats, wherein each paper side weave repeat unit comprises at least two like first floats having different lengths and forming part of the paper side weave, and wherein said at least two like first floats are like relative to one another if all of said at least two like first floats are either said first over-floats or said first under-floats.

2. The forming fabric according to claim 1, wherein at least two first like floats having different lengths are formed by the weaving of the first yarn weaving with the second yarns.

3. The forming fabric according to claim 1, wherein said like first floats being defined by under-floats of said first yarns under one of said second yarns and by under-floats of said first yarns under at least two of said consecutive second yarns.

4. The forming fabric according to claim 1, wherein said like first floats being defined by over-floats of said first yarns over one of said second yarns and by over-floats of said first yarns over at least two of said consecutive second yarns.

5. The forming fabric according to claim 1, wherein said paper side weave repeat unit further comprise at least two like second floats having different lengths, wherein second over-floats are defined by weaving of said second yarns over one or more consecutive first yarns, wherein second under-floats are defined by weaving of said second yarns under one or more consecutive first yarns and wherein said at least two like second floats are like relative to one another if all of said at least two like second floats are either said second over-floats or said second under-floats.

6. The forming fabric according to claim 5, wherein at least two second like floats having different lengths being formed by the weaving of a second yarn weaving with first yarns.

7. The forming fabric according to claim 5, wherein said like second floats being defined by under-floats of said second yarns under one of said first yarns and by under-floats of said second yarns under at least two of said consecutive first yarns.

8. The forming fabric according to claim 5, wherein said like second floats being defined by over-floats of said first yarns over one of said second yarns and by first over-floats of said first yarns over at least two of said consecutive second yarns.

9. The forming fabric according to claim 1, wherein said first yarns are weft yarns and that said second yarns are warp yarns.

10. The forming fabric according to claim 1, wherein said first yarns are warp yarns and that said second yarns are weft yarns.

11. The forming fabric according to claim 1, wherein said forming fabric further comprises at least one pair of binder yarns, the binder yarns of which alternating weave with paper side yarns and with wear side yarns such that they together form a full weave path as one said first or one said second yarn of the paper side weave.

12. The forming fabric according to claim 11, wherein said paper side yarns and wear side yarns extending in cross direction relative to said binder yarns have a ratio of one of 1:1, 2:1 and 3:2.

13. The forming fabric according to claim 1, wherein said forming fabric is formed by weave repeat units determined by said paper side weave and a wear side weave, the repeat unit of the fabric comprising 16 warp yarns or more.

14. The forming fabric according to claim 1, wherein the repeat unit of the fabric comprises 24 weft yarns or more.

15. The forming fabric according to claim 1, wherein the paper side weave comprises at least two adjacent unlike first floats having a difference in height equal to or greater than 0.02 mm, wherein said at least two adjacent unlike first floats are unlike relative to one another if one of said two adjacent unlike first floats is said first over-float and the other of said two adjacent unlike first floats is said first under-float or vice versa.

16. The forming fabric of claim 15, wherein the height difference between said at least two adjacent unlike first floats is approximately 0.02 mm to approximately 0.08 mm.

17. A forming fabric having a textured forming surface, the forming surface comprising a paper side weave formed by interweaving of first and second yarns, said second yarns extending in cross direction relative to said first yarns, the paper side weave provides pockets, a pocket being defined by a recessed area forming a void in said forming surface of the forming fabric such that said void is defined by at least one first yarn weaving under at least two consecutive second yarns, the pockets having a depth being defined by the difference of level of said first yarns when weaving over said second yarns and when weaving under said second yarns, the depth of said pocket being equal or greater than 0.02 mm.

18. A method of manufacturing a board and packaging paper web, wherein the paper web is formed on a forming surface of a forming fabric, said forming surface formed by a paper side weave of said forming fabric, said paper side weave being repeated in paper side repeat units, the forming surface being textured such that each said paper side repeat unit includes first yarns weaving with second yarns, said second yarns extending in cross direction relative to said first yarns, said first yarns weave over one or more consecutive second yarns to define first over-floats and under one or more consecutive second yarns to define first under-floats, wherein each paper side weave repeat unit comprises at least two like first floats having different lengths and forming part of the paper side weave, and wherein said at least two like first floats are like relative to one another if all of said at least two like first floats are either said first over-floats or said first under-floats.

* * * * *